US012163509B2

(12) United States Patent
Duerr et al.

(10) Patent No.: US 12,163,509 B2
(45) Date of Patent: Dec. 10, 2024

(54) AIR COMPRESSION DEVICE

(71) Applicant: Robert Bosch GmbH, Stuttgart (DE)

(72) Inventors: Thomas Duerr, Asperg (DE); Carla-Maria Finck, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 252 days.

(21) Appl. No.: 17/753,756

(22) PCT Filed: Sep. 21, 2020

(86) PCT No.: PCT/EP2020/076210
§ 371 (c)(1),
(2) Date: Mar. 14, 2022

(87) PCT Pub. No.: WO2021/063713
PCT Pub. Date: Apr. 8, 2021

(65) Prior Publication Data

US 2022/0372960 A1 Nov. 24, 2022

(30) Foreign Application Priority Data

Sep. 30, 2019 (DE) ..... 10 2019 215 023.3

(51) Int. Cl.
*F04B 35/01* (2006.01)
*F04B 35/04* (2006.01)
(Continued)

(52) U.S. Cl.
CPC ..... *F04B 35/01* (2013.01); *F04B 35/04* (2013.01); *F04B 39/121* (2013.01); *F04B 39/14* (2013.01); *F04B 35/06* (2013.01)

(58) Field of Classification Search
CPC ..... F04B 35/01; F04B 35/04; F04B 35/06; F04B 39/14; F04B 39/121
See application file for complete search history.

(56) References Cited

U.S. PATENT DOCUMENTS 5,639,226 A * 6/1997 Boutrup ..... F04B 35/04 417/462
6,997,396 B2 * 2/2006 Fedorov ..... B05B 7/2429 239/311
(Continued)

FOREIGN PATENT DOCUMENTS

CN 202926547 U 5/2013
CN 103403260 A 11/2013
(Continued)

OTHER PUBLICATIONS

CN_206707960U_mt (Year: 2017).*
(Continued)

*Primary Examiner* — Essama Omgba
*Assistant Examiner* — Charles W Nichols
(74) *Attorney, Agent, or Firm* — Maginot, Moore & Beck LLP

(57) ABSTRACT

An air compression device includes: a compressor device for the compression of air, wherein the compressor device has a compressor axis and the compressor axis is defined by a direction in which air is compressed by the compressor device; an electric motor for driving the compressor device, wherein the electric motor has an electric motor axis formed by an axis of rotation of the electric motor; and a transmission that mechanically connects the electric motor to the compressor device. The transmission arranges the compressor device and the electric motor at an angle to one another, and the compressor axis and the electric motor axis enclose an angle between 10° and 80°, in particular 20° and 70°, more specifically 30° and 60°.

19 Claims, 10 Drawing Sheets

(51) Int. Cl.

| | |
|---|---|
| ***F04B 39/12*** | (2006.01) |
| ***F04B 39/14*** | (2006.01) |
| *F04B 35/06* | (2006.01) |

(56) References Cited

U.S. PATENT DOCUMENTS

| | | | | |
|---|---|---|---|---|
| 2006/0013709 | A1* | 1/2006 | Hudson | F04B 17/03 417/234 |
| 2007/0292282 | A1 | 12/2007 | Schuetzle et al. | |
| 2014/0341758 | A1* | 11/2014 | Schuetzle | F04B 1/0421 417/313 |
| 2016/0186738 | A1 | 6/2016 | Schuetzle et al. | |
| 2018/0193932 | A1 | 7/2018 | Gall | |
| 2018/0238314 | A1 | 8/2018 | Hong | |
| 2019/0263363 | A1 | 8/2019 | McIntyre et al. | |

FOREIGN PATENT DOCUMENTS

| | | | | |
|---|---|---|---|---|
| CN | 206707960 | U * | 12/2017 | |
| WO | 2012/084074 | A1 | 6/2012 | |
| WO | WO-2018214161 | A1 * | 11/2018 | F04B 35/01 |

OTHER PUBLICATIONS

International Search Report corresponding to PCT Application No. PCT/EP2020/076210, mailed Nov. 11, 2020 (German and English language document) (5 pages).

* cited by examiner

AIR COMPRESSION DEVICE

This application is a 35 U.S.C. § 371 National Stage Application of PCT/EP2020/076210, filed on Sep. 21, 2020, which claims the benefit of priority to Serial No. DE 10 2019 215 023.3, filed on Sep. 30, 2019 in Germany, the disclosures of which are incorporated herein by reference in their entirety.

The present disclosure relates to an air compression device having a compressor device for compressing air.

BACKGROUND

An air compressor having a compressor device for compressing air, having an electric motor for driving the compressor device, and having a gearbox, is already known from the prior art.

SUMMARY

The present disclosure proceeds from an air compression device having a compressor device for compressing air, wherein the compressor device has a compressor axis and the compressor axis is predefined along a direction in which air is compressed by the compressor device; having an electric motor for driving the compressor device, wherein the electric motor has an electric motor axis which is formed by a rotation axis of the electric motor; and having a gearbox, wherein the gearbox mechanically connects the electric motor to the compressor device. It is proposed that the gearbox disposes the compressor device and the electric motor at an angle to one another, wherein the compressor axis and the electric motor axis form an angle in the range between 10° and 80°, in particular 20° and 70°, most particularly 30° and 60°.

The disclosed arrangement enables a particularly compact construction mode of the air compression device, as a result of which the ease-of-use by an operator can be increased. The particularly compact construction mode is achieved in that the gearbox disposes the compressor device and the electric motor at an angle to one another.

In the context of the present disclosure, an "air compression device" is in particular to be understood to be a hand-held air compression device which can be held in the hand of a user. The air compression device is configured for compressing air, in particular ambient air, in order to fill an object such as, for example, a ball such as a soccer ball, a basketball, a volleyball, or a tire such as an automobile tire, a bicycle tire, a motorcycle tire, or an inflatable boat, an air balloon, or the like, with air using the compressed air. The air compression device here by way of example can be configured as an air compressor apparatus or an electrically operated air pump.

The air compression device compresses air by using the compressor device. The compressor axis here is predefined along the direction in which air is compressed by the compressor device.

The electric motor is configured for driving the compressor device. A driveshaft of the electric motor is set in rotation if the electric motor is supplied with electrical power, wherein the driveshaft here forms the rotation axis. In this embodiment, the rotation axis is the electric motor axis.

The gearbox mechanically connects the electric motor to the compressor device such that the electric motor can drive the compressor device. Here, the driveshaft of the electric motor engages at least in part in the gearbox and drives the gearbox. Moreover, the gearbox is mechanically connected to the compressor device such that the gearbox transmits the rotation to the compressor device when the electric motor drives the gearbox.

According to the disclosure, the gearbox disposes the compressor device and the electric motor at an angle to one another, wherein the compressor axis and the electric motor axis form an angle in the range between 10° and 80°, in particular 20° and 70°, most particularly 30° and 60°. A particularly compact and manageable air compression device can be provided as a result.

In one embodiment, the gearbox is configured as a bevel gear, in particular as a crown gearhead. The gearbox has a gear wheel, in particular a crown gear wheel, wherein the gear wheel is rotatably mounted in a gearbox housing and connects the electric motor to the compressor device. The driveshaft of the electric motor engages in the gear wheel. The drive wheel transmits the rotation to the gear wheel as soon as the driveshaft is set in rotation. The gear wheel is set in rotation as a result. The compressor device is mechanically connected to the gearbox, in particular to the gear wheel, by means of a compressor con rod. The gear wheel has at least one receptacle for the compressor con rod. The compressor con rod can be connected to the gear wheel by using a compressor fastening element. For example, the receptacle of the gear wheel can be in the form of an opening with a thread such that the compressor fastening element can be configured as a screw, so that the compressor con rod can be connected to the gear wheel by means of the screw. It is also conceivable for the gear wheel to have at least one pin as the receptacle such that the compressor con rod can be connected to the gear wheel by way of a cut-out of the compressor con rod. The compressor con rod, by using the gearbox, is provided for converting the rotation of the gear wheel to a substantially axial movement. The substantially axial movement here is substantially along the compressor axis.

In one embodiment, a gearbox axis of the gearbox forms an angle in the range from 50° to 120°, in particular 60° to 110°, most particularly 70° to 100°, in each case with the compressor axis and the electric motor axis, wherein the gearbox axis is a rotation axis of the gearbox. The gearbox axis is that rotation axis about which the gear wheel rotates when the driveshaft of the electric motor drives the gear wheel and sets the latter in rotation. The gearbox axis can have the same angle in the range from 50° to 120° to the electric motor axis and the compressor axis. However, it is also conceivable for the gearbox axis to have dissimilar angles to the electric motor axis and the compressor axis in the range from 50° to 120°.

The at least one receptacle of the gear wheel and the gearbox axis can have a mutual spacing. This means that the at least one receptacle is formed on the gear wheel so as to be offset from the gearbox axis. As a result thereof, the gearbox can convert the rotation of the gear wheel to the substantially axial movement of the compressor con rod along the compressor axis.

In one embodiment, the gearbox has at least one first connection element and at least one second connection element, wherein the first connection element connects the compressor device to the gearbox, and the second connection element connects the electric motor to the gearbox. To this end, the first connection element can at least in portions receive the compressor device, and the second connection element can at least in portions receive the electric motor. For example, the first connection element and the second connection element can be configured in the manner of a disk, in the manner of a washer, in the manner of a cup, in the manner of a bowl, or the like. The first and/or the second connection element can thus be configured, for example, as a connection receptacle, a connection cup, a connection bowl, or as a connection disk.

The first connection element can enable a form-fitting, force-fitting and/or materially integral connection between the compressor device and the gearbox. It is also conceivable for the first connection element to be integral to the gearbox and/or to the compressor device. Furthermore, the first connection element can enable, for example, a screw connection, a snap-fit connection, a bayonet connection, a hook connection, a connection by means of at least one fastening element such as, by way of example, a screw, a nut, a bolt, a rivet, or the like, between the compressor device and the gearbox.

The second connection element can enable a form-fitting, force-fitting and/or materially integral connection between the electric motor and the gearbox. It is also conceivable for the second connection element so as to be integral to the gearbox and/or to the electric motor. Furthermore, the second connection element can enable, for example, a screw connection, a snap-fit connection, a bayonet connection, a hook connection, a connection by means of at least one fastening element such as, by way of example, a screw, a nut, a bolt, a rivet, or the like, between the electric motor and the gearbox.

In one embodiment, the first connection element and the second connection element are configured so as to be integral to the gearbox housing. It is also conceivable for the first connection element to be integral to the second connection element.

In one embodiment, the compressor device has a compressor housing, wherein the first connection element connects the compressor housing to the gearbox. The first connection element can at least in part receive the compressor housing and dispose the latter on the gearbox. Furthermore, the first connection element can enable a form-fitting, force-fitting and/or materially integral connection to the gearbox. For example, the compressor housing can be configured in the manner of a cup, a bowl, a cage, a frame, or the like. For example, the first connection element can thus form a screw connection, a snap-fit connection, a bayonet connection, a hook connection, a connection by means of at least one fastening element such as, by way of example, a screw, a nut, a bolt, a rivet, or the like, to the compressor housing.

The compressor housing moreover comprises a compressor connection element for connecting the air compression device to at least one air compression hose. The compressor connection element can be configured as a compressor coupling or as a compressor plug. The compressor connection element is configured in such a manner that said compression connection element can form a form-fitting and/or force-fitting connection to the air compression hose. The air compression hose here can be rotatably connected to the compressor connection element. The compressed air can flow to the compressor connection element by way of the compressor outlet and the compressor valve. The compressed air can flow into the air compression hose when the air compression hose is connected to the compressor connection element so that the user can fill the object with air.

In one embodiment, the compressor device has a compressor cylinder and a compressor piston, wherein the compressor piston is configured for compressing air in the compressor cylinder, and the first connection element connects the compressor cylinder to the gearbox. The compressor housing is configured in such a manner that said compressor housing receives at least the compressor cylinder. The compressor housing here can at least in part enclose the compressor cylinder. Furthermore, the compressor housing can be disposed about the compressor cylinder in the manner of a cage. The compressor housing can receive the compressor cylinder in a form-fitting and/or force-fitting manner, wherein it is also conceivable for the compressor cylinder to be integral to the compressor housing. The compressor cylinder can be configured in the manner of a cup, a vessel, or a bowl. The compressor cylinder here can have at least one compressor inlet and at least one compressor outlet. The compressor inlet is provided for permitting air to make its way into the compressor cylinder. The compressor outlet is configured for permitting compressed air to escape from the compressor cylinder. The compressor valve is disposed on the compressor outlet, wherein the compressor valve substantially closes the compressor outlet. The compressor valve is configured in such a manner that said compressor valve can permit the compressed air to escape at a predefined air pressure. To this end, the compressor valve opens and the compressed air escapes from the compressor cylinder by way of the compressor outlet.

Additionally, the first connection element can at least in part receive the compressor cylinder and connect the latter to the gearbox. The first connection element here can enable a form-fitting, force-fitting and/or materially integral connection between the compressor cylinder and the gearbox. By way of example, the first connection element can form a screw connection, a snap-fit connection, a bayonet connection, a hook connection, a connection by means of at least one fastening element such as, by way of example, a screw, a nut, a bolt, a rivet, or the like, to the compressor cylinder.

In one embodiment, the first connection element is additionally configured for guiding the compressor piston, in particular while driven by the electric motor, along the compressor axis. To this end, the first connection element has at least one piston guide element. The piston guide element can receive the compressor piston at least in a form-fitting manner and guide the latter along the compressor axis while the electric motor drives the compressor device. By using the piston guide element, the compressor con rod can convert the rotation of the gearbox, in particular of the gear wheel, to the substantially axial movement of the compressor piston substantially without any loss. The piston guide element can be embodied, for example, as an opening, as a cut-out, as a clearance, as a rail, as a web, in the manner of a hollow cylinder, or as a combination of these examples.

The compressor piston is connected to the compressor con rod. The compressor con rod here can be connected to the compressor piston in a form-fitting, force-fitting and/or materially integral manner, wherein it is also conceivable for the compressor piston to be integral to the compressor con rod. In one embodiment, the compressor con rod can be connected to the compressor piston, in particular mounted thereon, so as to be able to be pivoted and/or tilted. The compressor con rod is mechanically connected to the gearbox. Therefore, the gearbox can drive the compressor con rod.

The compressor piston can be mounted so as to be movable in the compressor cylinder. The compressor piston is thus configured in such a manner that, in a first operating direction, air can be compressed in the compressor cylinder by using the compressor piston and, in a second operating direction, the compressor cylinder can be filled with air. In the first operating direction, the compressor piston moves from the compressor inlet to the compressor outlet and thereby compresses the air situated in the compressor cylinder. In the second operating direction, the compressor piston moves from the compressor outlet to the compressor inlet such that the compressor cylinder can be filled with air. To this end, the compressor piston has at least one compressor seal. The compressor seal is disposed so as to at least in part encircle the compressor piston. Moreover, the compressor seal can be configured in the manner of a lip such that the compressor seal can be configured so as to be substantially impermeable to air in the first operating direction, and configured so as to be substantially permeable to air in the second operating direction. Here, the compressor seal can connect the compressor piston in a form-fitting manner to the compressor cylinder in the first operating direction such that the air situated in the compressor cylinder substantially cannot escape by way of the compressor inlet. Furthermore, the compressor seal can connect the compressor piston to the compressor cylinder in the second operating direction in such a manner that air can flow into the compressor cylinder by way of the compressor seal.

In this embodiment, the compressor axis is predefined along the direction in which air is compressed by the compressor device. Therefore, the compressor axis here is along the first operating direction of the compressor piston.

The compressor device thus comprises the compressor housing, the compressor cylinder, the compressor piston, the compressor con rod, and the compressor valve. Additionally, the compressor device has a compressor seal, a compressor inlet and a compressor outlet.

In one embodiment, the air compression device has an elongate housing, wherein the elongate housing receives at least a power supply for supplying the air compression device with electrical power, the gearbox, the compressor device and the electric motor. The elongate housing here comprises an elongate shape, for example in the manner of a cylinder, in the manner of a wedge, in the manner of a cuboid, or in the manner of a prism. The power supply is configured for supplying the air compression device with electrical power. The air compression device is preferably a rechargeable-battery operated air compression device which is able to be operated by means of at least one rechargeable battery. As a result thereof, the electrical power in this instance is provided by the power supply by means of the at least one rechargeable battery. The rechargeable battery of the air compression device here can be configured as a permanently installed rechargeable battery or as a replaceable rechargeable battery. The permanently installed rechargeable battery of the air compression device here can be disposed in the elongate housing. The replaceable rechargeable battery and the air compression device can form a releasable connection such that the user can connect the rechargeable battery to the air compression device and remove said rechargeable battery. Alternatively, the air compression device can be configured as a mains-operated air compression device.

The elongate housing can dispose the power supply, the gearbox, the compressor device and the electric motor within the housing. Here, the elongate housing can receive the power supply, the gearbox, the compressor device and the electric motor at least in a form-fitting manner. It is conceivable for the elongate housing to receive these elements in a force-fitting manner, or else to connect said elements to the housing by using at least one fastening element within the housing.

In one embodiment, the gearbox is disposed between the power supply and the electric motor and the compression device. Here, the gearbox can represent a type of arrangement center of the air compression device. The power supply is disposed in a first region of the air compression device. The compressor device and the electric motor are disposed in a second region of the air compression device. The gearbox is disposed so as to be substantially between the first region and the second region. A particularly ergonomic shape can be enabled as a result thereof.

In one embodiment, the elongate housing forms a Y-like shape. Here, the elongate housing has at least three housing axes which span the Y-like shape. These three housing axes intersect in at least one intersection point. The gearbox can be disposed on the intersection point of the three housing axes. The power supply can be disposed on a first housing axis. The compressor axis here forms a second housing axis such that the compressor device can be disposed on the second housing axis. The electric motor axis can form a third housing axis. Here, the electric motor can be disposed on the third housing axis.

It is also conceivable for the elongate housing to form a triangular shape. Here, in that case, the elongate housing has the triangular shape in section along the first housing axis.

In one embodiment, the power supply and the electric motor axis form an angle in the range from 100° to 200°, in particular 120° to 180°, most particularly 140° to 160°. Here, the first housing axis and the electric motor axis, in particular the third housing axis, can form the angle in the range from 100° to 200°. Therefore, the power supply and the electric motor comprise the angle in the range from 100° to 200°. As a result thereof, the ease-of-use for the operator is increased in that the power supply and the electric motor enable a balanced distribution of weight so that the air compression device is able to be held balanced in one hand of the user.

In one embodiment, the power supply and the compressor axis form an angle in the range from 110° to 210°, in particular 130° to 190°, most particularly 150° to 170°. The power supply can be disposed on the first housing axis such that the first housing axis and the compressor axis, in particular the second housing axis, can form the angle in the range from 110° to 210°. The power supply is disposed on the first housing axis relative to the compressor device and the electric motor in such a manner that as uniform as possible a distribution of weight is achieved so that the ease of handling by the user is enhanced.

In one embodiment, the air compression device has a control unit for controlling the air compression device, wherein the gearbox is disposed between the control unit and the electric motor and the compressor device. The control unit is configured for controlling at least the power supply and/or the electric motor. It is furthermore conceivable for the control unit to be able to control the compressor device. The housing here can receive the control unit and dispose the latter within the housing. The control unit can be disposed so as to be substantially parallel or transverse, in particular perpendicular, to the power supply. The control unit can be aligned along the first housing axis when the control unit is disposed so as to be substantially parallel to the power supply. The control unit can be disposed transversely, in particular perpendicularly, to the first housing axis when the control unit is disposed transversely, in particular perpendicularly, to the power supply.

In one embodiment, the control unit and the compressor axis form an angle in the range from 110° to 210°, in particular 130° to 190°, most particularly 150° to 170°. A particularly manageable air compression device can be provided with the aid of the angle in the range from 110° to 210° between the control unit and the compressor axis.

In one embodiment, the air compression device has an output and input unit, wherein the output and input unit is disposed so as to be substantially parallel to the compressor device, in particular the compressor axis. The output and input unit can at least in part be disposed in or on the housing. The output and input unit is specified for outputting visual, acoustic and/or haptic items of information to the user. Here, the visual, acoustic and/or haptic items of information may be an adjustable pressure, a currently prevailing pressure, a target pressure, warning signals to the user when a pressure is reached, current states of the power supply, a temperature of the compressor device, or a temperature of a power supply. The output and input unit, by way of example, can be configured as at least a display, a light emitting diode, a plurality of light emitting diodes, a vibration element and/or a loudspeaker. Furthermore, the output and input unit, by way of example, can be configured as at least a touch-sensitive display, an operating element, a main switch and/or a microphone.

The output and input unit is disposed so as to be substantially parallel to the compressor device, in particular the compressor axis. In the context of the present disclosure, "substantially parallel" is to be understood to be parallel or else so as to form an angle of up to 10°. Therefore, the output and input unit and the compressor device, in particular the compressor axis, can also form an angle of up to 10°. As a result thereof, it is made possible that the output and input unit is unobstructed in the field of view of the user while the latter uses the air compression device.

Moreover, the elongate housing is substantially without any visible fastening elements such that the user substantially cannot see any fastening elements such as, for example, screws, rivets, nuts, hooks, or the like, while using the air compression device.

Additionally or alternatively, the housing can have a housing connection element such that the air compression hose can be connected to the housing connection element.

Moreover, the housing can have at least one storage device, wherein the storage device is provided for storing accessories for the air compression device. For example, the storage device can be configured as a storage compartment, as a storage cut-out, as a storage receptacle, or the like. Here, the storage device can receive the accessories, such as, for example, an adapter for a bicycle valve, a ball needle, a valve cap, or an adapter for a low-pressure application, and connect those to the housing at least in a form-fitting manner. The storage device can be covered, in particular closed, by means of a storage lid. Here, the storage lid can be disposed so as to be displaceable and/or pivotable on the housing.

The air compression hose can be fastened to the elongate housing by means of at least one fastening means. For example, the elongate housing to this end can have a receptacle, in particular a U-shaped or C-shaped snap-fit receptacle, a hook, a rail, a web, a groove, a clearance, a cut-out, an opening, or the like. Additionally or alternatively, the air compression hose, by way of example, can have a web, a rail, in particular a T-shaped rail, a ring, a hook, or the like. It is also conceivable for the air compression hose to be able to be connected to the elongate housing by using a magnetic connection.

Furthermore, the air compression device can have at least one pressure measuring module which is configured for measuring at least one pressure. To this end, the pressure measuring module can measure the pressure generated by the compressor device as well as the pressure prevailing in the object. The pressure measuring module can be disposed on the housing, the gearbox, on the compressor device, the electric motor, the power supply and/or the control unit. Moreover, the air compression device, in particular the compressor device and/or the pressure measuring module, comprises/comprise at least one overpressure unit. The overpressure unit is provided for permitting pressure to escape from the compressor device when the pressure exceeds an adjustable and/or predefined pressure.

In one embodiment, the electric motor is additionally configured for generating an airflow within the housing. It is furthermore proposed that the air compression device has in air-directing device which, by using the gearbox, directs the airflow from the power supply to the compressor device and to the electric motor, wherein the air-directing device is at least in portions disposed within the elongate housing.

Additionally, the electric motor is configured for generating the airflow within the elongate housing. To this end, the electric motor can have at least one fan. As soon as the driveshaft of the electric motor is set in rotation, the fan is also set in rotation. As a result thereof, the fan set in rotation can generate the airflow within the elongate housing. The fan can be disposed substantially on the driveshaft. Alternatively, it is conceivable for the driveshaft to be mechanically connected to the fan so as to transmit the rotation of the driveshaft to the fan.

The compressor device, the electric motor, the gearbox and the power supply are at least in portions disposed in the elongate housing. The elongate housing encloses at least partially, in particular substantially completely, the compressor device, the electric motor, the gearbox and the power supply, and as a result thereof disposes said compressor device, said electric motor, said gearbox and said power supply in the elongate housing.

The elongate housing moreover has at least one air intake opening, wherein the air intake opening is configured for the intake of air into the elongate housing. As a result, it is made possible that the airflow can be generated as soon as the electric motor is set in rotation, in that air makes its way, in particular is aspirated, into the elongate housing by way of the air intake opening. For example, the air intake opening can at least in portions be configured in the manner of a ring, in the manner of a slot, so as to be round, oval, elliptical or polygonal such as, for example, triangular, quadrangular, pentagonal and the like. The air intake opening can be assigned to the power supply such that the air intake opening is disposed closer to the power supply. Furthermore, the elongate housing has at least one air exhaust opening which is provided for guiding the air out of the elongate housing. As a result thereof, it is achieved that the airflow can flow out of the elongate housing, in particular be pumped out of the housing, by way of the air exhaust opening. The air exhaust opening, by way of example, can at least in portions be configured in the manner of a ring, in the manner of a slot, so as to be round, oval, elliptical or polygonal such as, for example, triangular, quadrangular, pentagonal and the like. The air exhaust opening can be assigned to the compressor device and/or to the electric motor such that the air exhaust opening is disposed closer to the compressor device and/or to the electric motor.

Apart from the efficient cooling of at least the power supply, the gearbox, the compressor device and the electric motor, the airflow within the elongate housing of the air compression device also enables a suitable supply of air to the compressor device such that the compressor device can compress air provided during operation.

The air compression device advantageously has the air-directing device which, by using the gearbox, directs the airflow from the power supply to the compressor device and to the electric motor, wherein the air-directing device is at least in portions disposed within the elongate housing. The elongate housing can receive the air-directing device and at least partially enclose the latter. Furthermore, the elongate housing can form a form-fitting, force-fitting and/or materially integral connection to the air-directing device. It is also conceivable for the air-directing device to be integral to the elongate housing.

The air-directing device is configured in such a manner that said air-directing device guides the airflow from the power supply to the compressor device and to the electric motor by way of the gearbox. Furthermore, the air-directing device, by using the gearbox, disposes the power supply in the first region of the air compression device. Moreover, the air-directing device, by using the gearbox, disposes the compressor device and the electric motor in the second region of the air compression device. The gearbox is disposed so as to be substantially between the first region of the air compression device and the second region of the air compression device. The gearbox is in particular situated between the power supply and the compressor device and the electric motor, and insulates the first region from the second region. The air-directing device directs the airflow from the first region of the air compression device into the second region of the air compression device by way of the gearbox. Here, the air-directing device makes it possible for the airflow to be able to flow from the first region of the air compression device to the second region of the air compression device substantially exclusively by way of the gearbox.

In one embodiment, the air-directing device has at least one air-directing element, wherein the air-directing element directs the airflow from the power supply to the gearbox. The air-directing element can be connected to the air-directing device in a form-fitting, force-fitting and/or materially integral manner. Moreover, it is conceivable for the air-directing element to be integral to the air-directing device. The air-directing element directs the airflow within the elongate housing from the first region of the air compression device to the gearbox. Furthermore, the air-directing element is configured, in particular disposed in the housing, in such a manner that said air-directing element additionally substantially prevents the airflow from flowing into the second region of the air compression device without in the process flowing to the gearbox. The airflow thus flows from the first region of the air compression device into the second region of the air compression device substantially exclusively by using the air-directing element and the gearbox.

In one embodiment, the air-directing element is configured as a gearbox lid of the gearbox. To this end, the gearbox has the gearbox lid. The gearbox lid can be configured, for example, in the manner of a disk, of a tray, or of a cup.

The gearbox lid can be disposed on the gearbox, wherein the gearbox can receive the gearbox lid. To this end, the gearbox can have at least one gearbox lid receptacle for receiving the gearbox lid. The gearbox lid can be connected to the gearbox in a form-fitting, force-fitting and/or materially integral manner. It is conceivable for the gearbox lid to be able to be connected to the gearbox by means of at least one fastening element such as, for example, a screw, a nut, a rivet, or the like. Here, the gearbox lid can have a receptacle such as, for example, an opening, for the at least one fastening element. Furthermore, the gearbox lid can at least in portions close or enclose the gearbox. Moreover, the gearbox lid can have at least one air scoop. The air scoop can be connected to the gearbox lid in a form-fitting, force-fitting and/or materially integral manner. The air scoop is configured for directing the airflow from the power supply into the gearbox. It is furthermore conceivable for the gearbox lid to have at least one air intake opening. The air intake opening of the gearbox lid can be formed, for example, in the manner of a slot or so as to be round or oval. For example, a plurality of air intake openings of the gearbox lid can be provided, said plurality being in the range from 2 to 20.

It is possible for the gearbox lid to have a connection element for the housing. The connection element of the gearbox lid is provided for forming a connection between the gearbox lid and the housing. For example, the connection element of the gearbox lid can be formed as a web, an elevation, a hook or a cam. Here, the connection element of the gearbox lid can be connected to the gearbox lid in a form-fitting, force-fitting and/or materially integral manner, or else the connection element of the gearbox lid is integral to the gearbox lid. The connection element of the gearbox lid can form a form-fitting and/or force-fitting connection between the gearbox lid and the housing.

Alternatively, it is possible for the gearbox lid to receive the gearbox. To this end, the gearbox lid can be formed in the manner of a tray or a cup. Here, in this instance the gearbox can engage in the gearbox lid and form a form-fitting and/or force-fitting connection.

In one embodiment, the air-directing element is configured between the gearbox and the elongate housing. Here, the air-directing element can form a form-fitting and/or force-fitting connection to the gearbox and/or the elongate housing. Moreover, the air-directing element can at least in portions engage in the gearbox and/or the elongate housing. The air-directing element is configured between the gearbox and the elongate housing in such a manner that the airflow can be directed from the first region of the air compression device into the gearbox. The gearbox and/or the elongate housing can receive the air-directing element. The air-directing element can at least in portions be configured so as to encircle the gearbox. It is also conceivable for the air-directing element to be at least in portions configured so as to encircle the elongate housing.

In one embodiment, the air-directing element is configured as a seal, in particular a rubber seal, which at least in portions is disposed so as to encircle the gearbox. The seal is configured in such a manner that said seal can at least in portions engage in the gearbox. The gearbox can have a receptacle for the seal in order to receive the seal at least in a form-fitting manner. Furthermore, the seal can engage in the elongate housing, wherein the elongate housing can have a receptacle for the seal. The seal can be elastically deformable.

In one embodiment, the gearbox receives the elongate housing in the manner of a tongue-and-groove connection, wherein the tongue-and-groove connection forms the air-directing element. The tongue-and-groove connection can be configured so as to encircle the gearbox and the elongate housing. Here, the gearbox can form the groove or the tongue, wherein the groove or the tongue is connected to the gearbox in a form-fitting, force-fitting and/or materially integral manner. It is furthermore conceivable for the groove or the tongue to be integral to the gearbox. Moreover, the elongate housing can form the tongue or the groove, wherein the tongue or the groove is connected to the elongate housing in a form-fitting, force-fitting and/or materially integral manner. It is possible for the tongue or the groove to be integral to the housing. By virtue of the tongue-and-groove connection, the elongate housing can at least in portions engage in the gearbox, or vice versa.

In one embodiment, the air-directing device has at least one air-directing opening, wherein the air-directing opening directs the airflow from the power supply into the gearbox. The air-directing opening can be configured, for example, so as to be circular, elliptical, or else rectangular, square, polygonal or in the shape of a slot. More than one air-directing opening may also be provided in order to direct the airflow from the power supply, in particular from the first region of the air compression device, into the gearbox.

In one embodiment, the air-directing device has at least one first air-directing guide element and at least one second air-directing guide element, wherein the first air-directing guide element guides at least a first partial airflow of the airflow from the gearbox to the compressor device, and the second air-directing guide element guides at least a second partial airflow of the airflow from the gearbox to the electric motor. The first air-directing guide element and the second air-directing guide element are disposed on the gearbox and can be connected to the gearbox in a form-fitting, force-fitting and/or materially integral manner, wherein it is also conceivable for said air-directing guide elements to be integral to the gearbox.

The first air-directing guide element can be configured as a first air directing guide cut-out or a first air directing guide opening. For example, the first air-directing guide element can be configured in the manner of a hollow cylinder or a tube, wherein the first air-directing guide element, by way of example, can also have a polygonal shape or be configured in the manner of a slot, or at least in portions in an annular manner. The first air-directing guide element is configured for guiding the first partial airflow in the direction toward the compressor device as soon as the airflow flows into the gearbox. Once the compressor device is in operation, the compressor device substantially compresses air that is provided by the first partial airflow.

The second air-directing guide element can be formed as a second air directing guide cut-out or a second air directing guide opening. By way of example, the second air-directing guide element can at least in portions be formed as annular openings or be configured in the manner of a slot. The second air-directing guide element is configured for guiding the second partial airflow to the electric motor as soon as the airflow flows into the gearbox. The second partial airflow is provided for cooling at least the electric motor.

In one embodiment, the first connection element additionally forms the first air-directing guide element, and the second connection element additionally forms the second air-directing guide element. It is also conceivable for the first air-directing guide element to be integral to the first connection element, and for the second air-directing guide element to be integral to the second connection element.

In one embodiment, the air-directing device has at least one further air-directing element, wherein the further air-directing element directs the airflow, in particular the second partial airflow, from the electric motor to the compressor device. The further air-directing element is provided for directing the airflow, in particular the second partial airflow, from the electric motor in the direction toward the compressor device in order for the compressor device to be cooled. As soon as the electric motor, by using the fan, generates the airflow and the airflow, in particular the second partial airflow, has flowed substantially through the electric motor for the purpose of cooling the electric motor, the further air-directing element directs the airflow, in particular the second partial airflow, in the direction toward the compressor device.

The further air-directing element is disposed at the electric motor. The further air-directing element can be configured on the electric motor, on the gearbox, on the elongate housing and/or on the compressor device. The further air-directing element can thus be connected to the electric motor, the gearbox, the elongate housing and/or the compressor device in a form-fitting, force-fitting and/or materially integral manner. It is also conceivable for the further air-directing element to be integral to the gearbox, the electric motor, the elongate housing and/or the compressor device. The elongate housing preferably forms the further air-directing element.

In one embodiment, the electric motor is additionally configured for generating a further airflow, and the air-directing device, in particular by using the further air-directing element, directs the further airflow from the electric motor to the compressor device. The further airflow is generated by using the fan once the electric motor is operated. The elongate housing has at least one further air intake opening into which air for generating the further airflow can flow into the elongate housing. The further air intake opening can be configured at the electric motor in the elongate housing. For example, the further air intake opening can at least in portions be configured in the manner of a ring, of a slot, so as to be round, oval, elliptical or polygonal such as, for example, triangular, quadrangular, pentagonal and the like.

Apart from directing the airflow, in particular the second partial airflow, the air-directing device is additionally configured for directing the further airflow from the electric motor in the direction toward the compressor device, in particular by using the further air-directing element. It is thus possible for the airflow, in particular the second partial airflow, to mix with the further airflow once the airflow, in particular the second partial airflow, has flowed through the electric motor. The further airflow is provided for cooling the electric motor and/or the compressor device. Once the airflow, in particular the second partial airflow, and the further airflow have cooled the compressor device, the air-directing device can direct the airflow, in particular the second partial airflow, and the further airflow in the direction toward the air exhaust opening. The airflow, in particular the second partial airflow, and the further airflow can flow out of the elongate housing by way of the air exhaust opening.

In one embodiment, the gearbox has a gearbox housing, and the gearbox housing forms the air-directing device. The elongate housing can form a form-fitting, force-fitting and/or materially integral connection to the gearbox housing. Furthermore, the gearbox housing can receive or form the air-directing element. Moreover, the air-directing element can form a force-fitting, form-fitting and/or materially integral connection to the gearbox housing. It is also conceivable for the first air-directing guide element and the second air-directing guide element to form a force-fitting, form-fitting and/or materially integral connection to the gearbox housing, even to be integral to the gearbox housing. The air-directing opening can be configured as at least one cut-out or opening in the gearbox housing.

The first air-directing guide element, the first connection element, the second air-directing guide element, the second connection element, and the air-directing opening are preferably integral to the gearbox housing.

In one embodiment, the control unit for controlling the air compression device is disposed so as to be substantially parallel to the energy supply in the housing.

Apart from cooling the power supply, the airflow is additionally configured also for cooling of the control unit.

As soon as the electric motor generates the airflow, the airflow can flow along the power supply and the control unit for the purpose of cooling.

BRIEF DESCRIPTION OF THE DRAWINGS

The disclosure will be explained hereunder by means of a preferred embodiment. In the drawings.

DETAILED DESCRIPTION

Figure 1:
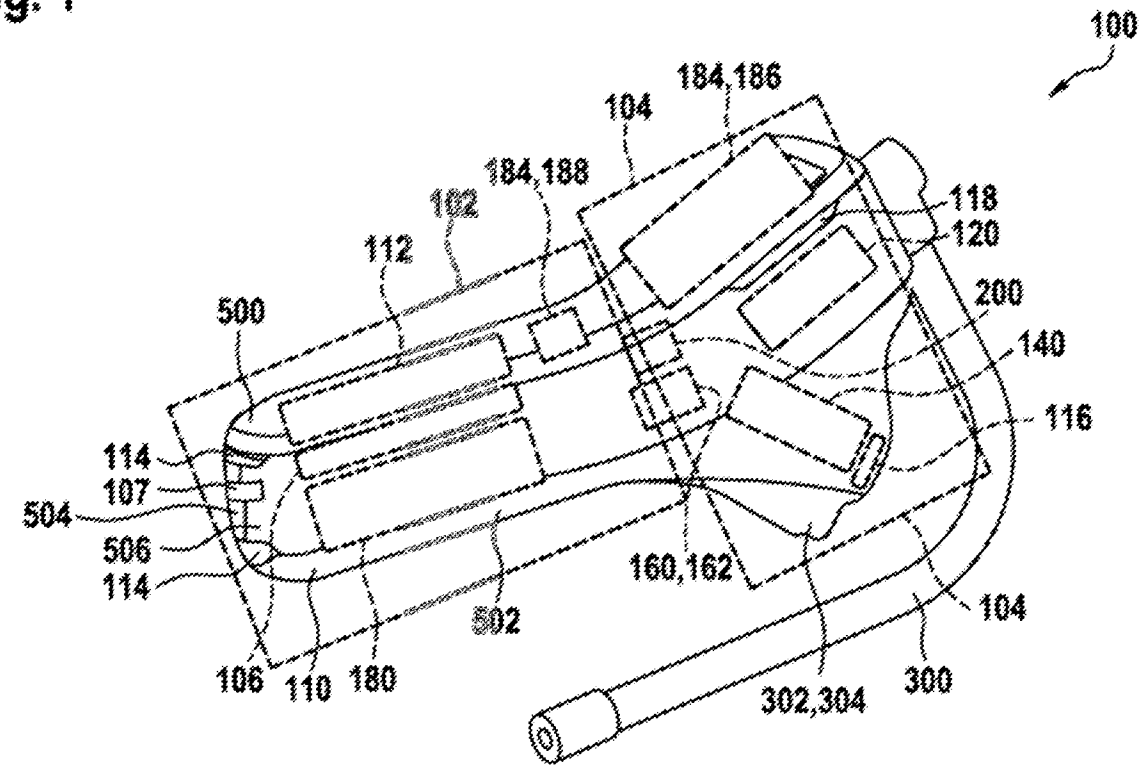
FIG. 1 shows a perspective view of an air compression device according to the disclosure.

FIG. 1 shows an air compression device 100 according to the disclosure. By way of example, here the air compression device 100 is configured as a hand-held electric air compressor apparatus. The air compression device 100 comprises a housing 110, a compressor device 124 for compressing air, an electric motor 140 for driving the compressor device 120 and for generating an airflow 190 within the housing 110, a gearbox 160, wherein the gearbox 160 mechanically connects the electric motor 140 to the compressor device 120, and a power supply 180 at least for supplying the electric motor 140 with power; see also FIG. 2.

The power supply 180 supplies the air compression device 100 with electrical power. This embodiment is a rechargeable-battery-operated air compression device which is able to be operated by using at least one rechargeable battery. The at least one rechargeable battery is embodied here as a permanently installed rechargeable battery.

In this embodiment, the gearbox 160 is disposed between the power supply 180 and the electric motor 140 and the compressor device 120. The power supply 180, the electric motor 140, and the compressor device 120 are disposed about the gearbox 160. The power supply 180 is disposed in a first region 102 of the air compression device 100. The compressor device 120 and the electric motor 140 are disposed in a second region 104 of the air compression device 100. Here, the gearbox 160 is disposed so as to be substantially between the first region and the second region.

The air compression device 100 furthermore comprises a control unit 106 for controlling the air compression device 100. In this embodiment, the gearbox 160 is disposed between the control unit 106 and the electric motor 140 and the compressor device 120. Here, the control unit 106 is provided for controlling the power supply 180, the electric motor 140 and the compressor device 120. The housing 110 receives the control unit 106. Furthermore, the control unit 106 is disposed within the housing 110. In this embodiment, the control unit 106 is disposed so as to be substantially parallel to the power supply 180 within the housing 110. Moreover, the control unit 106 has at least one connector element 107 which here, by way of example, is in the form of a USB-C coupling. The connector element 107 is provided for forming at least one plug connection to a plug element, for example a USB-C plug, in order to transmit the electrical power for charging the permanently installed rechargeable battery.

Moreover, the air compression device 100 comprises an output and input unit 184. In this embodiment, the output and input unit 184 is disposed so as to be substantially parallel to the compressor device 120. Furthermore, the output and input unit 184 is at least in part disposed in the housing 110. Here, the output and input unit 184, by way of example, is formed as at least one display 186 having at least one operating element and as a main switch 188. The operating element of the output and input unit 184 is not illustrated in more detail here. In this embodiment, the output and input unit 184 is disposed so as to be substantially parallel to the compressor device 120.

The housing 110 comprises at least one storage device 112. The storage device 112 is configured for storing accessories for the air compression device 100. Here, the storage device 112, by way of example, is formed as a storage compartment; see also FIG. 7 to this end.

The compressor device 120, the electric motor 140, the gearbox 160, the power supply 180 and the control unit 106 are at least in portions disposed in the housing 110. The housing 110 receives the power supply 180, the gearbox 160, the compressor device 120, the electric motor 140 and the control unit 106 at least in a form-fitting manner. Here, the housing 110 of the air compression device 100 is formed as an elongate housing 110. In this respect, the elongate housing 110 has an elongate shape which here, by way of example, is configured in the manner of a wedge; see also FIGS. 2 and 5 to this end.

In this embodiment, the elongate housing 110 comprises two air intake openings 114 which here are formed in the first region 102 of the air compression device 100 at the power supply 180 and here, by way of example, are formed so as to be elliptical. The air intake openings 114 enable air to enter the elongate housing 110. Moreover, the elongate housing 110 comprises two air exhaust openings 118 which are configured in the second region 104 of the air compression device 100 at the compressor device 120. Furthermore, the air exhaust openings 118 here, by way of example, are formed in the manner of slots; see also FIGS. 2 and 5. The air exhaust openings 118 are configured for directing air out of the elongate housing 110.

The air compression device 100 furthermore comprises an air-directing device 200. The air-directing device 200 is at least in portions disposed within the elongate housing 110; see also FIGS. 2 and 3. Here, the elongate housing 110 receives the air-directing device 200 and at least partially encloses the latter. Furthermore, the air-directing device 200 is configured for directing an airflow 190 from the power supply 180 to the compressor device 120 and to the electric motor 140 by using the gearbox 160. As soon as the electric motor 140 is supplied with electric power, a fan 146 of the electric motor 140 is set in rotation and as a result thereof generates the airflow 190 within the elongate housing 110. Here, air enters the elongate housing 110 by way of the air intake openings 114 and exits the elongate housing 110 from the air exhaust openings 118; see also FIGS. 2 and 3.

Additionally, the air-directing device 200, by using the gearbox 160, disposes the power supply 180 in the first region 102 of the air compression device 100. The air-directing device 200, also by using the gearbox 160, disposes the compressor device 120 and the electric motor 140 in the second region of the air compression device 100. Here, the air-directing device 200 is configured for directing the airflow 190 from the first region 102 into the second region 104 by way of the gearbox 160. Here, the gearbox 160 is disposed so as to be substantially between the first region 102 and the second region 104.

Figure 2:
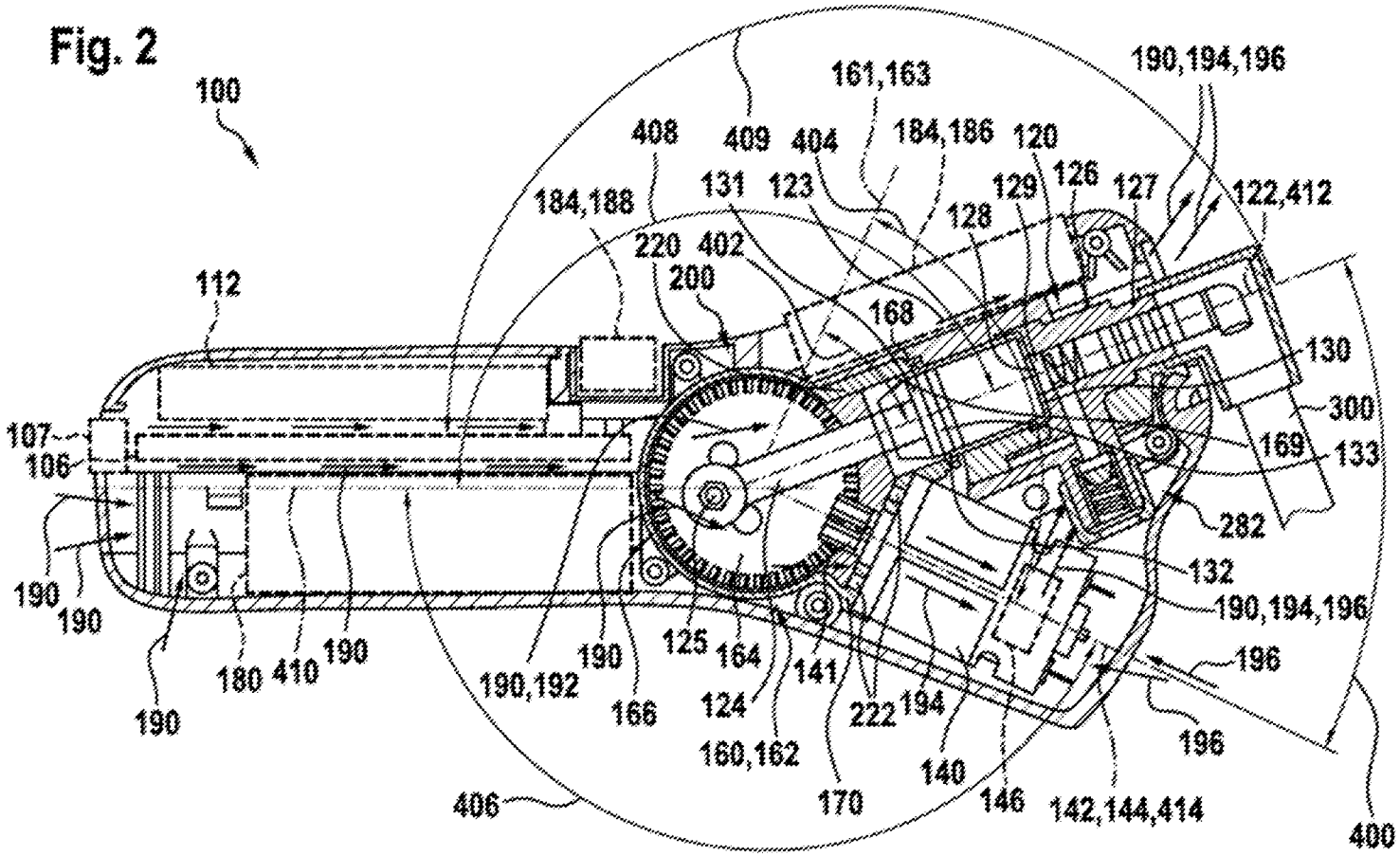
FIG. 2 shows a first longitudinal section through the air compression device.

FIG. 2 shows a first longitudinal section through the air compression device 100. The gearbox 160 comprises a first connection element 168 and a second connection element 170; see also FIG. 4 to this end. The compressor device 120 is connected to the gearbox 160 by means of the first connection element 168, wherein the first connection element 168 receives the compressor device 120 at least in portions. The first connection element 168 enables a form-fitting connection between the compressor device 120 and the gearbox 160. In this embodiment, the first connection element 168 is formed in the manner of a washer and is integral to the gearbox 160. The electric motor 140 is connected to the gearbox 160 by means of the second connection element 170, wherein the second connection element 170 receives the electric motor 140 at least in portions. Moreover, the second connection element 170 establishes a form-fitting connection between the electric motor 140 and the gearbox 160. By using the second connection element 170, the electric motor 160 can be connected to the gearbox housing 166 by means of at least one fastening element, which is not illustrated in more detail. Here, the second connection element 170 is formed in the manner of a tray. In this embodiment, the first connection element 168 and the second connection element 170 are integral to the gearbox housing 166.

The compressor device 120 has a compressor axis 122, wherein the compressor axis 122 is predefined along a direction 123 in which air is compressed by the compressor device 120. As soon as the electric motor 140 is supplied with electrical power, a driveshaft 141 of the electric motor 140 is set in rotation and in the process forms a rotation axis 142. The rotation axis 142 of the electric motor 140 here represents an electric motor axis 144.

The gearbox 160 disposes the compressor device 120 and the electric motor 140 at an angle to one another. Here, the compressor axis 122 and the electric motor axis 144 form an angle 400 in the region between 10° and 80°. By using the gearbox 160, the electric motor 140 is mechanically connected to the compressor device 120. As a result, the electric motor 140 drives the compressor device 120. In the process, the driveshaft 141 engages at least in part in the gearbox 160.

The gearbox 160 is embodied here as a bevel gear 162. In this respect, the gearbox 160 comprises a gear wheel 164. The gear wheel 164 is rotatably mounted in a gearbox housing 166. The gearbox housing 166 is configured for connecting the electric motor 140 to the compressor device 120. Here, the driveshaft 141 engages in a form-fitting manner in the gear wheel 164. A rotation axis 161 of the gearbox 160, the former here representing the gearbox axis 163, is formed as soon as the gear wheel 164 is set in rotation. The gearbox axis 163 is perpendicular to the drawing plane of FIG. 2 here.

The compressor device 120 has a compressor con rod 124. The compressor con rod 124 mechanically connects the compressor device 120 to the gearbox 160. To this end, the compressor con rod 124 is connected to the gear wheel 164. The gear wheel 164 comprises a receptacle 165 for the compressor con rod 124, and the compressor con rod 124 is connected to the gear wheel 164 by means of a compressor fastening element 125. In this embodiment, the receptacle 165 of the gear wheel 164 is formed as an opening with a thread. The compressor fastening element 125 is formed as a screw with a nut here. Here, the receptacle 165 of the gear wheel 164 and the gearbox axis 163 have a mutual spacing; see also FIG. 3. The gearbox 160 thus converts the rotation of the gear wheel 164 into a substantially axial movement of the compressor con rod 124 along the compressor axis 122.

The compressor device 120 furthermore comprises a compressor housing 126. By using the first connection element 168, the compressor housing 126 is connected to the gearbox 160. The compressor housing 126 here is formed in the manner of a cage and engages at least in part in the first connection element 168; see also FIGS. 3 and 4. Moreover, the compressor housing 126 has a compressor connection element 127 which is configured for connecting the air compression device 100 to an air compression hose 300. In this embodiment, the compressor connection element 127 is formed as a compressor coupling. The compressor connection element 127 forms a form-fitting connection to the air compression hose 300. The air compression hose 300 is rotatably connected to the compressor connection element 127.

Moreover, the compressor device 120 comprises a compressor cylinder 130 and a compressor piston 131. The compressor piston 131 compresses air in the compressor cylinder 130. The first connection element 138 additionally connects the compressor cylinder 130 in a form-fitting manner to the gearbox 160. The compressor housing 126 receives the compressor cylinder 130, wherein the compressor housing 126 at least partially encloses the compressor cylinder 130. Here, the compressor housing 126 is disposed about the compressor cylinder 130 in the manner of a cage. The compressor cylinder 130 is formed in the manner of a cup here. The compressor cylinder 130 comprises a compressor inlet 132 and a compressor outlet 128. Air can flow into the compressor cylinder 130 by way of the compressor inlet 132. Compressed air can flow out of the compressor cylinder 130 by way of the compressor outlet 128. The compressor device 120 has a compressor valve 129 which is disposed on the compressor outlet 128. The compressor valve 129 closes the compressor outlet 128 substantially in such a manner that the compressed air escapes at a predefined air pressure. The compressed air flows to the compressor connection element 127 by way of the compressor outlet 128 and the compressor valve 129.

Here, the compressor piston 131 is connected to the compressor con rod 124 at least in a form-fitting manner. Here, the compressor con rod 124 is mounted so as to be pivotable in the compressor piston 131. Moreover, the compressor piston 131 is mounted so as to be movable in the compressor cylinder 130. The compressor piston 131 comprises a compressor seal 133, wherein the compressor seal 133 is disposed so as to at least in part encircle the compressor piston 131. The compressor seal 133 is formed in the manner of a lip. The compressor seal 133 is substantially impermeable to air in a first operating direction of the compressor piston 131, and substantially permeable to air in a second operating direction of the compressor piston 131. As a result thereof, in the first operating direction of the compressor piston 131 the air in the compressor cylinder 130 can be compressed, and in the second operating direction of the compressor cylinder 130 air can flow into the compressor cylinder 130. In this embodiment, the first operating direction of the compressor piston 131 is along the direction 123 in which air is compressed, whereas the second operating direction of the compressor piston 131 is counter to the direction 123 in which air is compressed.

Therefore, the compressor device 120 has the compressor housing 126, the compressor cylinder 130, the compressor piston 131, the compressor seal 133, the compressor con rod 124 and the compressor valve 129.

The first connection element 168 is additionally provided for guiding the compressor piston 131 along the compressor axis 122 when the electric motor 140 drives the gear wheel 164. To this end, the first connection element 168 comprises a piston guide element 169. Here, the piston guide element 169 receives the compressor piston 131 at least in a form-fitting manner and guides the compressor piston 131 along the compressor axis 122. In this embodiment, the piston guide element 169 is configured as an opening in the manner of a hollow cylinder.

The air compression device 100 comprises a pressure measuring module 280; see also FIG. 4 to this end. The pressure measuring module 280 measures a pressure generated by the compressor device 120, and a pressure prevailing in an object which is connected by means of the air compression hose 300. The pressure measuring module 280 is disposed on the gearbox 160; see also FIG. 4. The air compression device 100 furthermore has an overpressure unit 282. The overpressure unit 282 permits a pressure to escape from the compressor device 120 as soon as an adjustable or predefined pressure is exceeded.

The elongate housing 110 forms a Y-like shape. Here, the elongate housing 110 comprises three housing axes 410, 412, 414. The three housing axes 410, 412, 414 span the Y-like shape. Moreover, the three housing axes 410, 412, 414 intersect in an intersection point. In this embodiment, the gearbox 160 is disposed on the intersection point of the three housing axes 410, 412, 414. The power supply 180 is disposed on a first housing axis 410. A second housing axis 412 is formed by the compressor axis 122, wherein the compressor device 120 is disposed on the second housing axis 412. A third housing axis 414 is formed by the electric motor axis 144. The electric motor 140 in this instance is disposed on the third housing axis 414.

The gearbox axis 163 forms an angle 402, 404 in the range from 50° to 120° in each case with the compressor axis 122 and the electric motor axis 144. In this respect, the angle 402 between the gearbox axis 163 and the compressor axis 122 is in the range from 50° to 120°. Furthermore, the angle 404 between the gearbox axis 163 and the electric motor axis 122 is in the range from 50° to 120°.

The power supply 180 and the electric motor axis 144 form an angle 406 in the range from 100° to 200°. In this embodiment, the first housing axis 410 and the electric motor axis 144 form the angle 406 in the range of 100° to 200°. Moreover, the power supply 180 and the compressor axis 122 form an angle 408 in the range from 110° to 210°. In this embodiment, the angle 408 is formed between the first housing axis 410 and the compressor axis 122.

In this embodiment, the control unit 106 is disposed so as to be substantially parallel to the power supply 180 such that the control unit 106 is disposed so as to be substantially parallel to the first housing axis 410 and along the first housing axis 410. As a result thereof, the control unit 106 and the compressor axis 122 form an angle 409 in the range from 110° to 210°.

The air compression device 100 comprises an air-directing device 200. The air-directing device 200, with the aid of the gearbox 160, directs the airflow 190 from the power supply 180 to the compressor device 120 and additionally to the electric motor 140. The air-directing device 200 is at least in portions disposed within the elongate housing 110. The air-directing device 200 in this embodiment is formed by the gearbox housing 166; see also FIGS. 3 and 4. The air-directing device 200 furthermore comprises an air-directing element 210; see also FIG. 4*a*. The air-directing element 210 is configured in such a manner that said air directing element 210 directs the airflow 190 from the power supply 180 to the gearbox 160.

Furthermore, the air-directing device 200 comprises a first air-directing guide element 220 and a second air-directing guide element 222. The first air-directing guide element 220 guides a first partial airflow 192 of the air flow 190 from the gearbox 160 to the compressor device 120. Here, the first air-directing guide element 220 is formed as a first air-directing guide opening in the manner of a hollow cylinder. The second air-directing guide element 222 guides a second partial airflow 194 of the airflow 190 from the gearbox 160 to the electric motor 140. Here, the second air-directing guide element 222 is configured as four second air-directing guide openings, wherein the four air-directing guide openings have in each case an opening which is annular at least in portions. In this embodiment, the first air-directing guide element 220 and the second air-directing guide element 222 are configured so as to be integral to the gearbox housing 166; see also FIGS. 4*a* and *b*. Moreover, the first connection element 168 additionally forms the first air-directing guide element 220 here. Furthermore, the second connection element 170 additionally forms the second air-directing guide element 222 here. As a result thereof, here the first air-directing guide element 220 is integral to the first connection element 168, and the second air-directing guide element 222 is integral to the second connection element 170.

Figure 3:
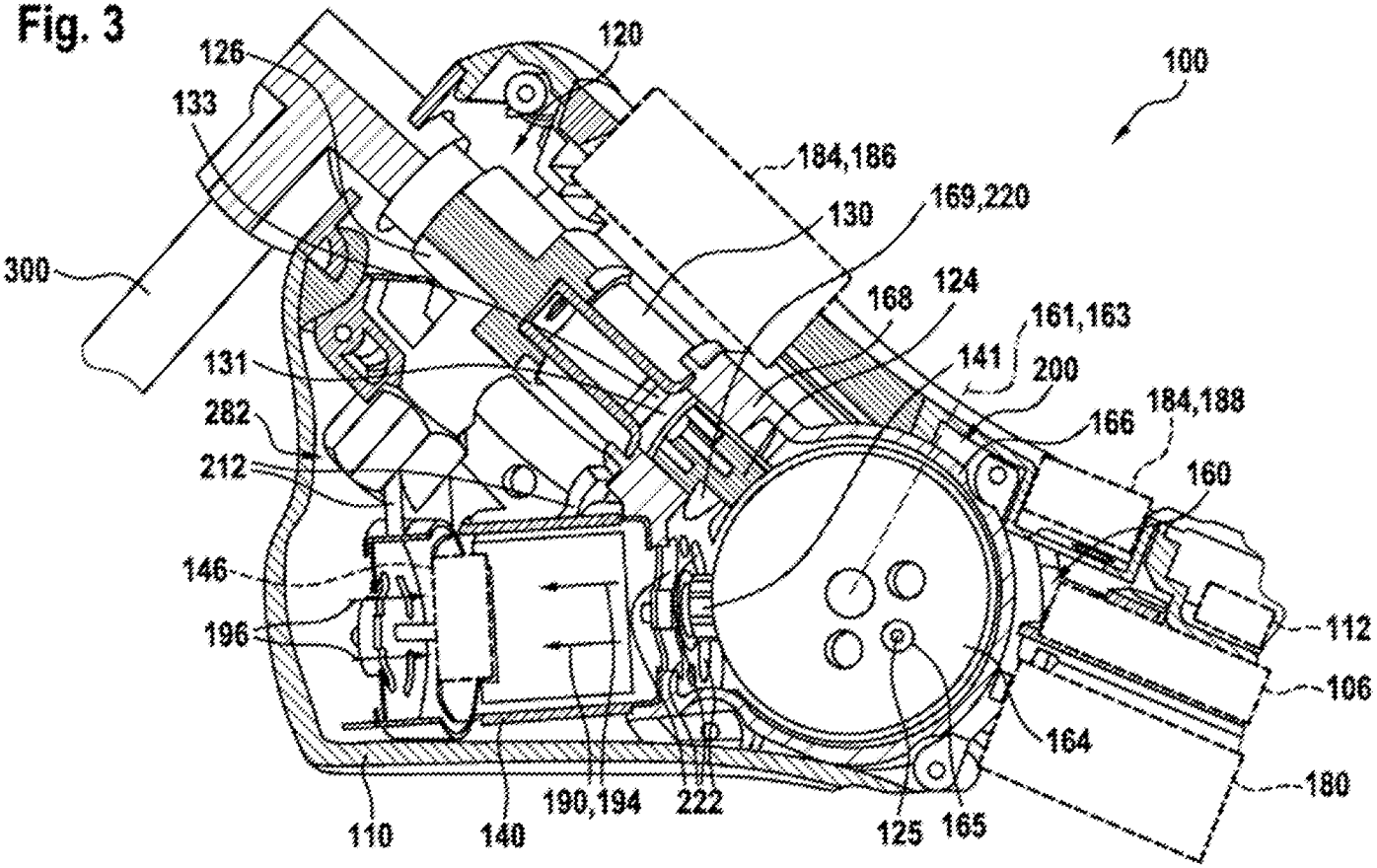
FIG. 3 shows a second longitudinal section through the air compression device.

FIG. 3 illustrates a second longitudinal section through the air compression device 100. The air-directing device 200 comprises two further air-directing elements 212 which here are formed as air-directing webs. The further air-directing elements 212 direct the second partial airflow 194 from the electric motor 140 to the compressor device 120 for the purpose of cooling. In this embodiment, the further air-directing elements 212 are formed by the elongate housing 110 and are disposed at the electric motor 140. Moreover, by using the fan 146, the electric motor 140 additionally generates a further airflow 196 as soon as the electric motor 140 is set in rotation. The air-directing device 200 is additionally provided for directing the further airflow 196 from the electric motor 140 to the compressor device 120 for the purpose of cooling by using the further air-directing elements 212.

Figure 5A:
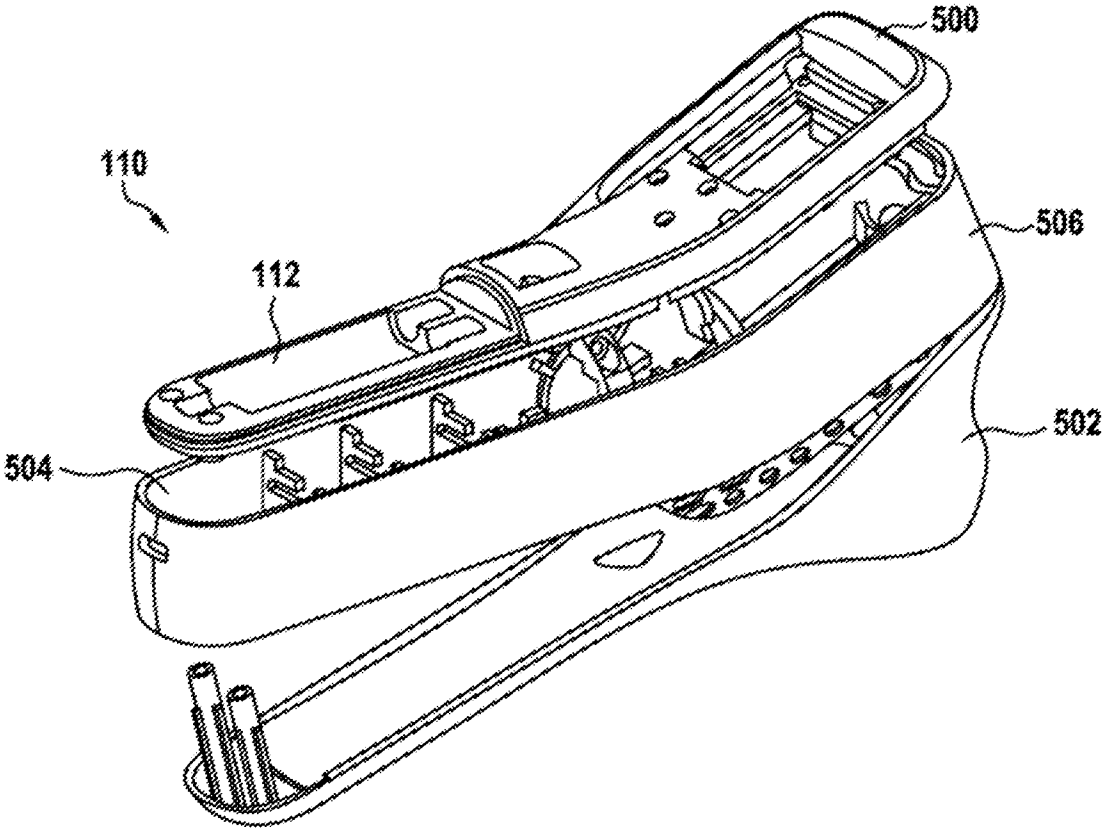
FIG. 5*a* shows an exploded view of a housing of the air compression device.
Figure 5B:
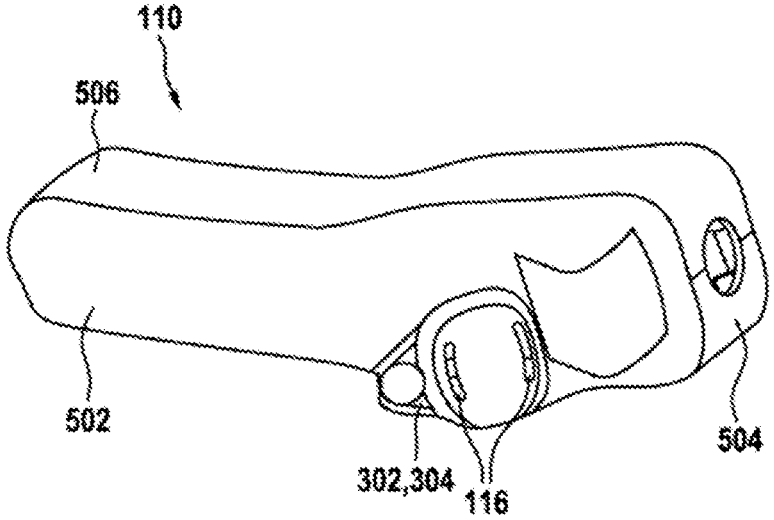
FIG. 5*b* shows a perspective view of the housing having a first embodiment of a hose fastening of the air compression device.

In order for the electric motor 140 to be able to generate the further airflow 196, the elongate housing 110 comprises further air intake openings 116; see also FIG. 5*b* to this end. Air can flow into the elongate housing 110 through the further air intake openings 116 and form the further airflow 196. Moreover, the further airflow 196 can flow out of the air exhaust openings 118. Two further air intake openings 116, which at least in portions have an annular shape, are formed here.

Figure 4A:
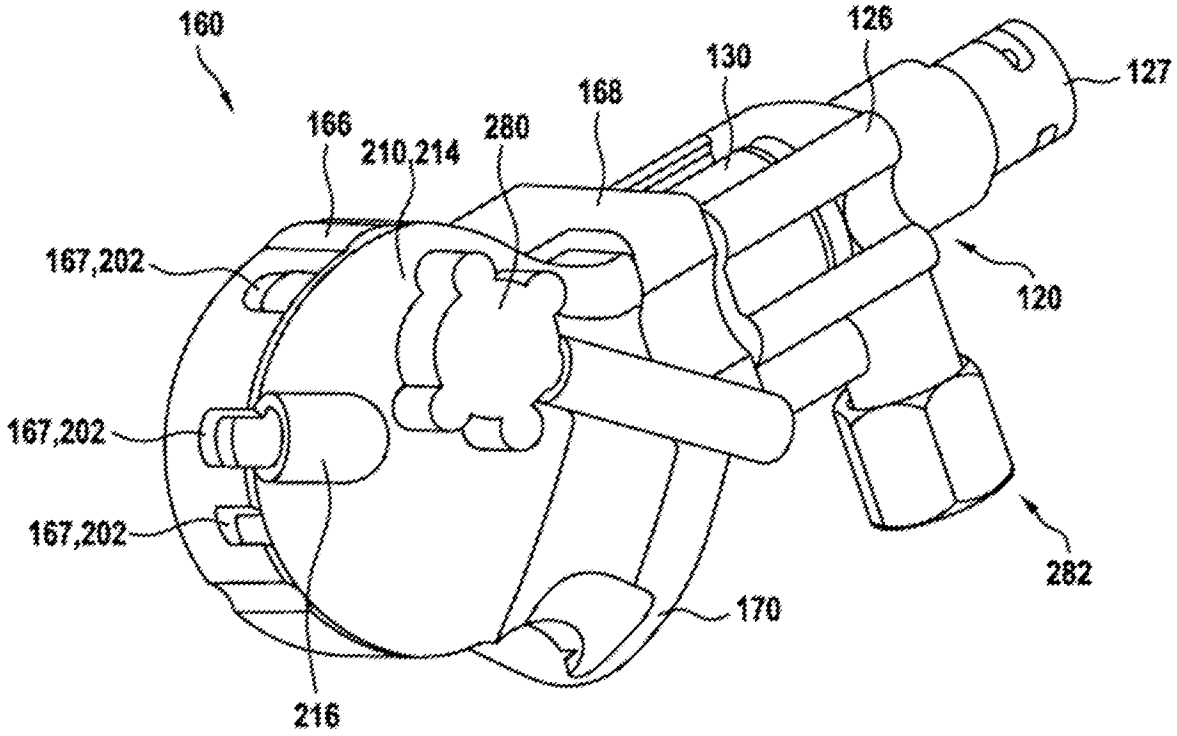
FIG. 4*a* shows a perspective view of a gearbox of the air compression device.

FIG. 4*a* shows a perspective view of the gearbox 160 of the air compression device 100. The air-directing device 200 comprises the air-directing element 210. In this embodiment, the air-directing element 210 is configured as a gearbox lid 214 of the gearbox 160. The gearbox lid 214 here is connected in a form-fitting manner to the gearbox housing 166. In this embodiment, the gearbox lid 214 is formed in the manner of a disk. Furthermore, the gearbox lid 214 comprises an air scoop 216. In this embodiment, the air scoop 216 is integral to the gearbox lid 214. The air scoop 216 directs the airflow 160 from the power supply 180 into the gearbox 160.

Moreover, the air-directing device 200 here comprises three air-directing openings 202. The air-directing openings 202 direct the airflow 190 from the power supply 180 into the gearbox 160. In this embodiment, the air-directing openings 202 are formed so as to be oval at least in portions. Moreover, here the air-directing openings 202 are in each case formed as an opening 167 in the gearbox housing 166.

As described above, the air compression device 100 comprises the pressure measuring module 280. Here, the pressure measuring module 280 is disposed on the gearbox lid 214 and is connected to the latter at least in a form-fitting manner. The compressor housing 126 receives the overpressure unit 282 and disposes the overpressure unit 282 at the electric motor 140.

Figure 4B:
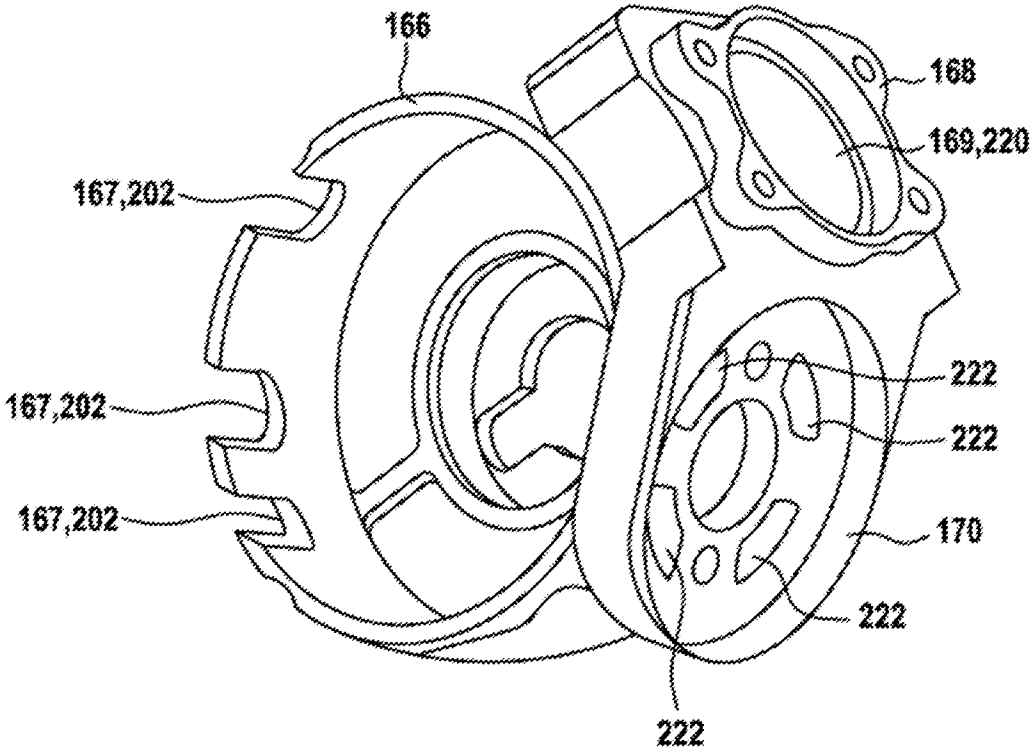
FIG. 4*b* shows a perspective view of a gearbox housing of the gearbox.

FIG. 4*b* shows a perspective view of the gearbox housing 166 of the gearbox 160. As described above, the air-directing device 200 comprises the first air-directing guide element 220 and the second air-directing guide element 222.

FIG. 5*a* illustrates an exploded view of the housing 110 of the air compression device 100. The housing 110 is formed so as to be elongate. Moreover, the elongate housing 110 is configured in the shape of a wedge. The elongate housing 110 comprises a housing upper shell 500, a housing lower shell 502, a first housing lateral shell 504 and a second housing shell 506. The elongate housing 110 is configured in such a manner that a user substantially cannot see any visible fastening elements of the elongate housing 110 when using the air compression device 100. The housing lower shell 502 thus receives the first housing lateral shell 504 and the second housing lateral shell 506 at least in portions in a form-fitting manner. The first housing lateral shell 504 and the second housing lateral shell 506 receive the housing upper shell 500 at least in portions in a form-fitting manner.

FIG. 5*b* shows a perspective view of the housing 110 having a first embodiment 304 of a hose fastening of the air compression device 100. The housing lower shell 502 has the two further air intake openings 116. Furthermore, the housing lower shell 502 forms the fastening means 302 for the air compression hose 300. The fastening means 302 here serves for fastening the hose to the elongate housing 110. Here, in the first embodiment 304 the fastening means 302 is formed as a C-shaped snap-fit receptacle.

Figure 6A:
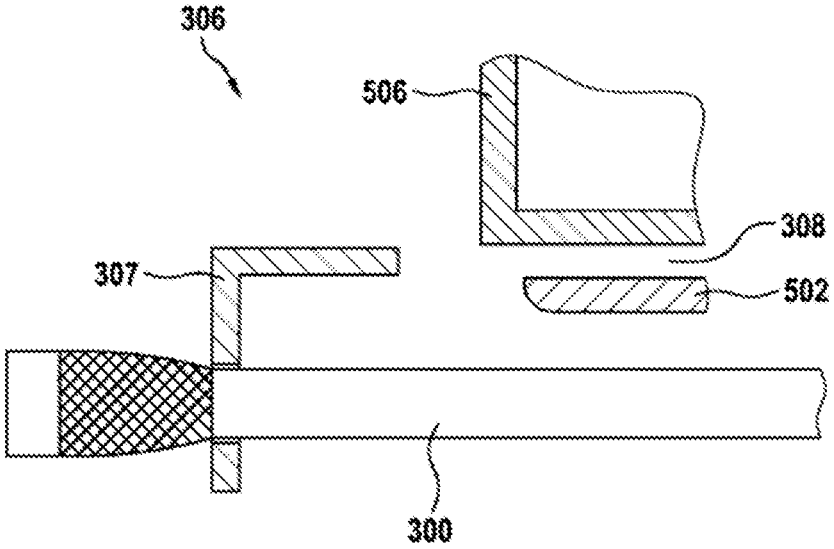
FIG. 6*a* shows a second embodiment of the hose fastening of the air compression device.

FIG. 6*a* illustrates a second embodiment 306 of the hose fastening of the air compression device 100. Here, the air compression hose 300 has a hook 307 for fastening the hose. Moreover, a hook receptacle 308 for the hook 307 of the air compression hose 300 is formed between the housing lower shell 502 and the second housing lateral shell 506. The hook receptacle 308 can receive the hook 307 in a form-fitting manner.

Figure 6B:
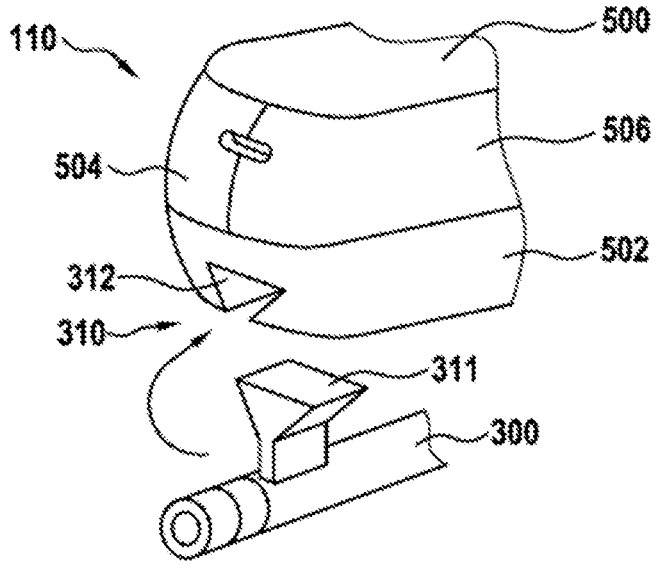
FIG. 6*b* shows a third embodiment of the hose fastening.

FIG. 6*b* shows a third embodiment 310 of the hose fastening. Here, the air compression hose 300 has a rail 311 in the manner of a prism with a triangular base area. The housing lower shell 502 here has a receptacle 312 in the manner of a prism with a triangular base area, such that the receptacle 312 can receive the rail 311 at least in a form-fitting manner.

Figure 6C:
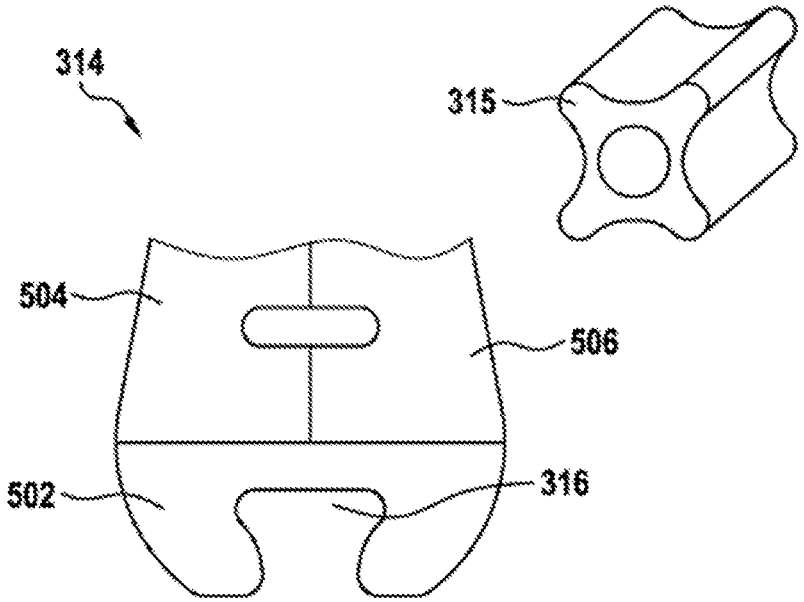
FIG. 6*c* shows a fourth embodiment of the hose fastening.

FIG. 6*c* shows a fourth embodiment 314 of the hose fastening. In the fourth embodiment 314, the air compression hose 300 has a rail 315 with a quadrangular base area. The housing lower shell 502 here comprises a receptacle 316 which is formed as a prism with a substantially quadrangular base area.

Figure 6D:
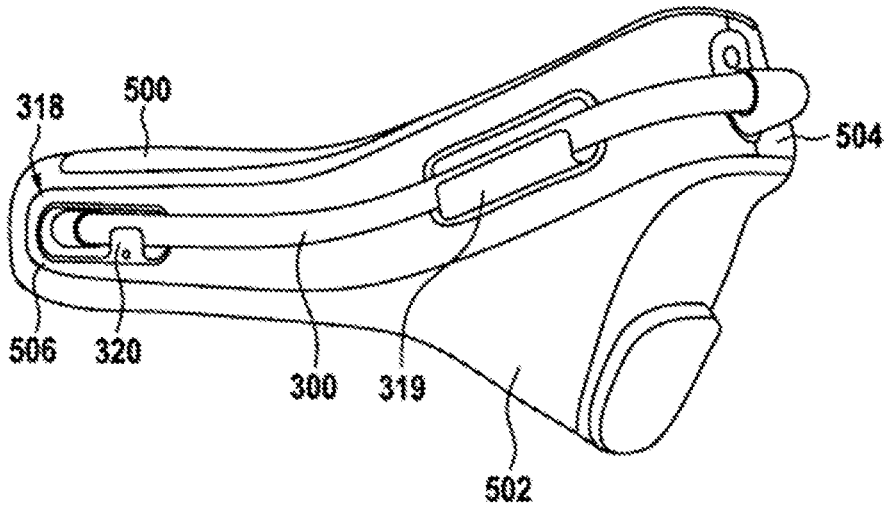
FIG. 6*d* shows a fifth embodiment of the hose fastening.

FIG. 6*d* shows a fifth embodiment 318 of the hose fastening. Here, the second housing lateral shell 506 has a first C-shaped snap-fit receptacle 319 and a second C-shaped snap-fit receptacle 320. The air compression hose 300 can be connected to the second housing lateral shell 506 in a form-fitting manner by means of the first C-shaped snap-fit receptacle 319 and the second C-shaped snap-fit receptacle 320.

Figure 6E:
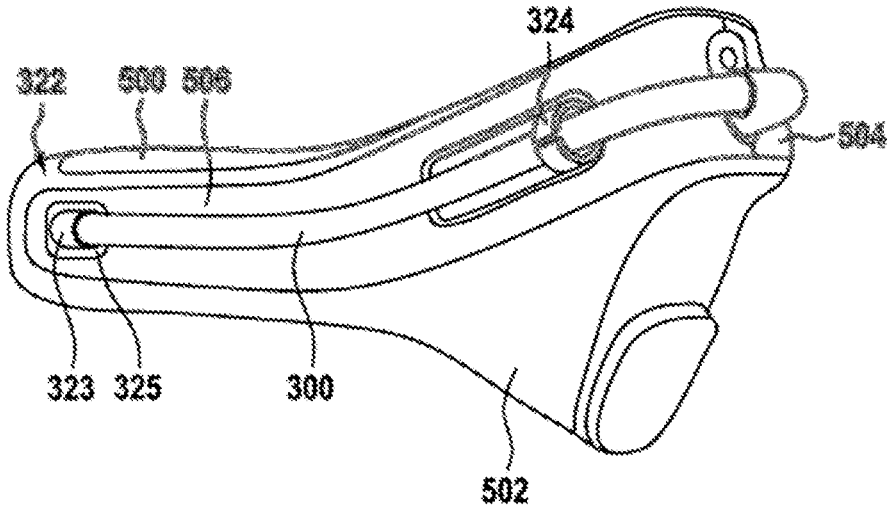
FIG. 6*e* shows a sixth embodiment of the hose fastening.

FIG. 6*e* illustrates a sixth embodiment 320 of the hose fastening. Here, the air compression hose 300 has a magnetic head 323. Furthermore, the second housing lateral shell 506 comprises a C-shaped snap-fit receptacle 324 and a magnetic receptacle 325. The air compression hose 300 can be connected at least in a form-fitting manner to the second lateral housing shell 506 by way of the C-shaped snap-fit receptacle 324. Additionally, the air compression hose 300 can be connected to the second housing shell 506 by way of a magnetic connection between the magnetic head 323 and the magnetic receptacle 325.

Figure 7:
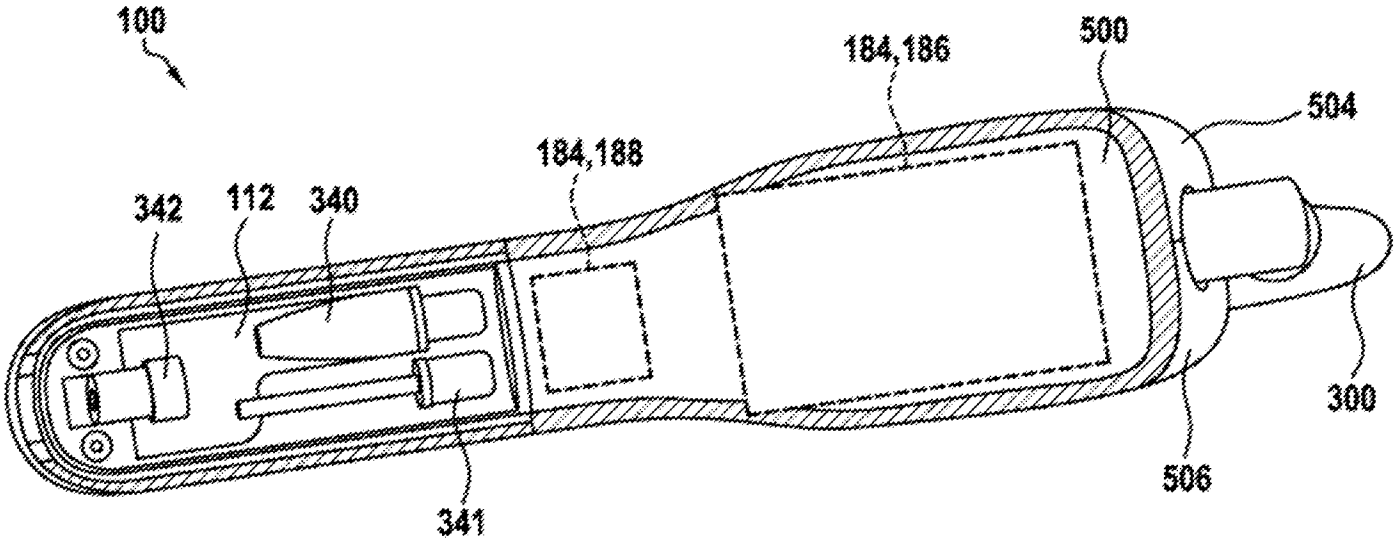
FIG. 7 shows a view from above of the air compression device having a storage device.

FIG. 7 shows a view from above of the air compression device 100 having the storage device 112. The elongate housing 110 comprises the storage device 112. Here, the storage device 112 is formed as a storage compartment in the housing upper shell 500. The storage device 112 can receive accessories for the air compression device 100, adapters 340, 341, 342, such that the user can insert the adapters 340, 341, 342 to suit the specific situation. The storage device 112 receives the adapters 340, 341, 342 at least in a form-fitting manner. The storage device 112 is closed by a storage lid, which is not illustrated in more detail.

The invention claimed is:

1. An air compression device comprising:

a compressor device configured to compress air, the compressor device having a compressor axis predefined by a direction in which air is compressed by the compressor device;

an electric motor configured to drive the compressor device, the electric motor having an electric motor axis formed by a rotation axis of the electric motor;

a gearbox including a gearbox housing and a bevel gear, the gear box housing defining (i) a gear space to receive the bevel gear, (ii) a first connection element configured to mechanically connect to the compressor device, and (iii) a second connection element configured to mechanically connect to the electric motor, such that the gear box housing mechanically connects the electric motor to the compressor device, wherein the gearbox housing disposes the compressor device and the electric motor so as to be at an angle to one another, wherein the compressor axis and the electric motor axis form an angle of between 10° and 80°, wherein the first connection element defines a first air directing guide element configured to direct a first partial airflow of a main airflow from the gearbox housing to the compressor device to be compressed, and wherein the second connection element defines a second air directing guide element configured to direct a second partial airflow of the main airflow from the gearbox housing to the electric motor.

2. The air compression device as claimed in claim 1, wherein:

a gearbox axis of the gearbox forms an angle in the range from 50° to 120° with respect to each of the compressor axis and the electric motor axis, the gearbox axis being a rotation axis of the gearbox.

3. The air compression device as claimed in claim 2, wherein:

the compressor axis is coplanar with the electric motor axis, and the gearbox axis is perpendicular with the compressor axis and the electric motor axis.

4. The air compression device as claimed in claim 1, wherein the compressor device has a compressor housing, and the first connection element connects the compressor housing to the gearbox housing.

5. The air compression device as claimed in claim 1, wherein;

the compressor device has a compressor cylinder and a compressor piston, the compressor piston is configured for compressing air in the compressor cylinder, and the first connection element connects the compressor cylinder to the gearbox housing.

6. The air compression device as claimed in claim 5, wherein the first connection element is further configured to guide the compressor piston along the compressor axis while the compressor piston is driven by the electric motor.

7. The air compression device as claimed in claim 1, further comprising:

an elongate housing; and a power supply for supplying the air compression device with electrical power, the gearbox, the compressor device and the electric motor, the power supply received in the elongate housing.

8. The air compressor device as claimed in claim 7, wherein the gearbox is disposed between the power supply and the electric motor and the compressor device.

9. The air compressor device as claimed in claim 7, wherein the elongate housing forms a Y-like shape.

10. The air compression device as claimed in claim 7, wherein the power supply and the electric motor axis form an angle of from 100° to 200°.

11. The air compression device as claimed in claim 10, wherein the angle formed by the power supply and the electric motor axis is between 140° to 160°.

12. The air compression device as claimed in claim 1, further comprising:

a control unit configured to control the air compression device, wherein the gearbox is disposed between the control unit and the electric motor and the compressor device.

13. The air compression device as claimed in claim 12, wherein the control unit and the compressor axis form an angle of from 110° to 210°.

14. The air compression device as claimed in claim 13, wherein the angle formed by the control unit and the compressor axis is between 150° to 170°.

15. The air compression device as claimed in claim 1, further comprising:

an output and input unit disposed so as to be substantially parallel to the compressor device.

16. The air compression device as claimed in claim 15, wherein the output and input unit is disposed so as to be substantially parallel to the compressor axis.

17. The air compression device as claimed in claim 1, wherein the angle formed by the compressor axis and the electric motor axis is between 20° and 70°.

18. The air compression device as claimed in claim 1, wherein the angle formed by the compressor axis and the electric motor axis is between 30° and 60°.

19. The air compression device as claimed in claim 1, wherein the bevel gear includes a crown gearhead.

* * * * *